US012180623B2

(12) United States Patent
Gerth et al.

(10) Patent No.: US 12,180,623 B2
(45) Date of Patent: Dec. 31, 2024

(54) DEVICE FOR HANDLING HARNESS ELEMENTS AND DRAWING-IN MACHINE

(71) Applicant: Groz-Beckert KG, Albstadt (DE)

(72) Inventors: Christian Gerth, Meersburg (DE); Stefan Kailer, Meßstetten (DE); Bernd Pfeffer, Haigerloch (DE); Michael Acker, Albstadt (DE); Karl-Heinz Gesing, Raesfeld (DE)

(73) Assignee: GROZ-BECKERT KG, Albstadt (DE)

( * ) Notice: Subject to any disclaimer, the term of this patent is extended or adjusted under 35 U.S.C. 154(b) by 342 days.

(21) Appl. No.: 17/620,254

(22) PCT Filed: Jun. 15, 2020

(86) PCT No.: PCT/EP2020/066502
§ 371 (c)(1),
(2) Date: Dec. 17, 2021

(87) PCT Pub. No.: WO2020/254253
PCT Pub. Date: Dec. 24, 2020

(65) Prior Publication Data

US 2022/0372678 A1 Nov. 24, 2022

(30) Foreign Application Priority Data

Jun. 19, 2019 (EP) ..... 19181162

(51) Int. Cl.
*D03J 1/14* (2006.01)

(52) U.S. Cl.
CPC ..... *D03J 1/14* (2013.01)

(58) Field of Classification Search
CPC ..... D03J 1/14; D03J 1/00
See application file for complete search history.

(56) References Cited

U.S. PATENT DOCUMENTS 1,624,928 A 4/1927 Colman
4,910,837 A * 3/1990 Fujimoto ..... D03J 1/001 28/208

(Continued)

FOREIGN PATENT DOCUMENTS

CN 101812763 A 8/2010
CN 102292485 A 12/2011

(Continued)

OTHER PUBLICATIONS

China National Intellectual Property Administration; First Office Action in corresponding Chinese Application No. 202080044596.9, dated Aug. 25, 2022; 16 pages.

(Continued)

*Primary Examiner* — Khoa D Huynh
*Assistant Examiner* — Uyen T Nguyen
(74) *Attorney, Agent, or Firm* — Fitch, Even, Tabin & Flannery LLP

(57) ABSTRACT

A device for handling weaving accessories, which is provided as a mobile unit, is disclosed herein. The device comprises a holding device for holding a reed, a holding device for holding healds, a holding device for holding drop wires and a holding device for holding a thread sheet. The holding device for holding the reed is provided for picking up a reed disposed movably at the holding device.

6 Claims, 1 Drawing Sheet

(56) References Cited

U.S. PATENT DOCUMENTS

| | | | | | |
|---|---|---|---|---|---|
| 4,934,413 | A * | 6/1990 | Yao | D03J 1/001 | 139/109 |
| 5,136,762 | A * | 8/1992 | Gironi | D03J 1/14 | 28/201 |
| 5,253,404 | A * | 10/1993 | Weber | D03J 1/14 | 28/201 |
| 5,361,467 | A | 11/1994 | Jaeger et al. | | |
| 5,371,930 | A * | 12/1994 | Lindenmueller | D03J 1/001 | 28/208 |
| 5,394,596 | A * | 3/1995 | Lindenmuller | D03J 1/001 | 28/208 |
| 5,450,880 | A * | 9/1995 | Briner | D03J 1/001 | 28/208 |
| 5,775,380 | A * | 7/1998 | Roelstraete | D03J 1/14 | 28/208 |
| 6,050,302 | A * | 4/2000 | Guse | D03J 1/001 | 139/85 |
| 2011/0283498 | A1* | 11/2011 | Hunziker | D03J 1/14 | 28/205 |

FOREIGN PATENT DOCUMENTS

| | | | |
|---|---|---|---|
| CN | 105648643 | A | 6/2016 |
| CN | 205474256 | U | 8/2016 |
| CN | 205529299 | U | 8/2016 |
| CN | 205592281 | U | 9/2016 |
| CN | 106087210 | A | 11/2016 |
| CN | 206089969 | U | 4/2017 |
| DE | 4310838 | A1 | 10/1994 |
| EP | 0496232 | A1 | 7/1992 |
| JP | 2-26964 | A | 1/1990 |
| JP | 559641 | A | 3/1993 |
| JP | 6306749 | A | 11/1994 |

OTHER PUBLICATIONS

China National Intellectual Property Administration; Second Office Action in corresponding Chinese Application No. 202080044596.9, dated May 25, 2023; 5 pages.

European Search Report and Written Opinion dated Nov. 28, 2019, in corresponding European Application No. 19181162.9, with machine English translation (10 pages).

International Search Report and Written Opinion dated Sep. 18, 2020, in corresponding International Application No. PCT/EP2020/066502, with machine English translation (17 pages).

European Intent to Grant dated Nov. 17, 2021, in corresponding European Application No. 19181162.9, with machine English translation (49 pages).

Japan Patent Office; Notice of Reasons for Refusal in corresponding Japanese Patent Application No. 2021-575451, dated Mar. 6, 2024; 10 pages.

* cited by examiner

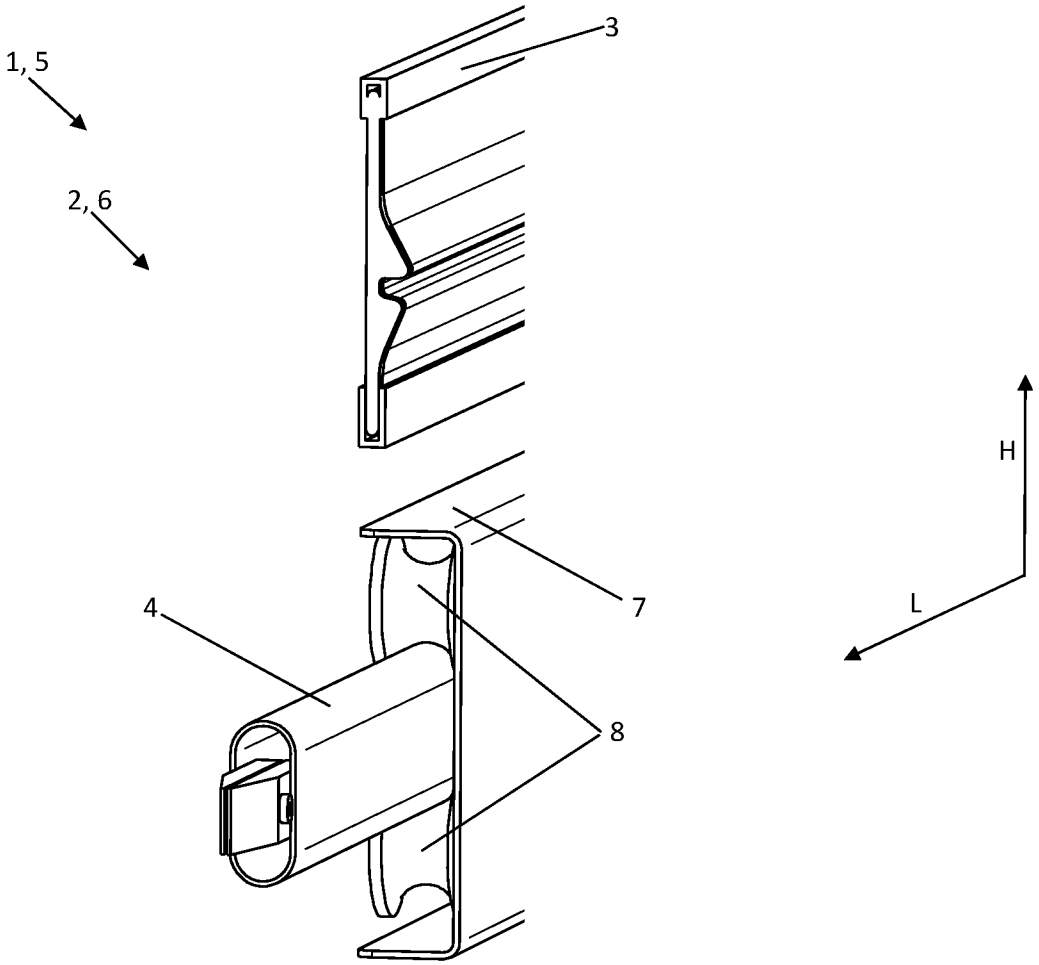
H
L
3
7
8
4
1,5
2,6

DEVICE FOR HANDLING HARNESS ELEMENTS AND DRAWING-IN MACHINE

CROSS REFERENCE TO RELATED APPLICATIONS

This patent application is the national phase of PCT/EP2020/066502, filed Jun. 15, 2020, which claims the benefit of European Patent Application No. 19181162.9, filed Jun. 19, 2019.

TECHNICAL FIELD

The present invention relates to a device for handling weaving accessories and to a drawing-in machine. It relates in particular to a mobile trolley, which may be a functional unit or a module of a drawing-in machine.

BACKGROUND

A drawing-in machine is a machine for drawing threads or warp threads into weaving accessories. It can be broken down into various functional units and has corresponding devices and components thereof. These include, for example, devices for the supply of healds and drop wires, through which the threads will be drawn. In these supply devices, the weaving accessories are suspended contiguously on rail-like guideways, as is generally the case, for example, for sales purposes or during weaving. On the so-called "loading side", additionally, a device is needed for holding a reed in readiness. The central device in a drawing-in machine is a drawing-in device that typically guides the threads or warp threads through reed, heald, drop wire and through components of a lease. On the "unloading side", i.e. after draw-in has been effected, the drawn-in drop wires and healds have to be transported away from the vicinity of the drawing-in device in order to prevent backward congestion. In the drawing-in device, healds and drop wires are mostly transported fast over short distances in order to achieve a high drawing-in repetition rate. After being drawn in, the weaving accessories have to be pushed over mostly lengthy, rail-like guideways. Their removal is mostly slow, although the weaving accessories have to travel relatively large distances. These are typically 2 to 3 m, but sometimes distances of up to 6 m are required. On the "unloading side", drop wires and healds are often transported away parallel, in devices arranged beside each other. The present invention is concerned with a mobile device, for example a weaving accessories trolley, for the supply and removal of weaving accessories at a drawing-in machine.

The DE4310838A1 describes an all-purpose transport trolley for use with various types of weaving accessory. The transport trolley serves exclusively for the transport of weaving accessories. In particular, it is neither intended nor suitable for use at a drawing-in machine.

The EP496232A1 shows a weaving accessories trolley which is located in the drawing-in machine during the drawing-in and automatically transports drop wires. After the drawing-in, the trolley remains in the drawing-in machine, the drawn-in weaving accessories are transferred to a warp-beam trolley. The drawing-in machine thus requires a huge amount of space, and it is awkward and time-consuming to install a new weaving accessories trolley or to refit the existing one.

SUMMARY

Starting out from the above-cited prior art, the object of the present invention is to provide a mobile unit which not only enables an automated drawing-in but which can also be exchanged quickly and in space-saving manner at a drawing-in machine. A space-saving drawing-in machine is also subject matter of the invention.

The device according to the invention for the handling of weaving accessories is provided as a mobile unit. The device comprises a holding means for holding a reed, a holding means for holding healds, a holding means for holding drop wires and a holding means for holding a thread sheet. According to the invention, the holding means for holding the reed is provided for picking up a reed movably disposed at the holding means.

With known drawing-in machines, the reed is moved during the drawing-in relative to holding means fixed immovably to the drawing-in machine. After the drawing-in, the reed is released and transferred to a weaving accessories trolley, for example with simple hooks. Since the holding means for the reed is fixed immovably to the drawing-in machine, the weaving-accessories trolley cannot be removed from the machine from the reed side. It is also difficult to introduce a newly equipped weaving accessories trolley or to refit the weaving accessories trolley on account of the holding means fixed to the machine. If the reed-holding means is arranged at the mobile unit, it is easy, after drawing-in has been effected, to remove the mobile unit from the machine from the reed side and to insert a newly equipped unit. As the holding means for a reed can be several metres long, the amount of space saved by not fixing the holding means immovably to the machine is huge. There is also a greater degree of freedom regarding the direction in which the mobile unit is removed from or introduced into the machine. Since the machines are close together in many weaving mills, handling of the weaving accessories is greatly facilitated by the above measure. If, for example, a shorter reed is drawn in than the construction of the drawing-in machine allows for, the space can be utilised better, also during the drawing-in, if the mobile unit does not exceed the length of the reed. Access to the other modules of the drawing-in machine is also facilitated when no trolley is arranged at the drawing-in machine.

The holding means for holding the reed may comprise a hollow profile extending in the longitudinal direction. Hollow profiles are particularly suitable for long devices, firstly because they offer a high level of rigidity relative to their weight and secondly because they have extensive outer surfaces on which holding elements can be guided via the holding device. In addition, hollow profiles can be connected simply and reliably at contact points.

In the region of its two ends, seen longitudinally, a hollow profile of the holding means for holding the reed may be arranged in vertically adjustable manner at the mobile unit. This enables the mobile unit to be attached quickly and snugly fitted to a drawing-in machine.

The holding means for holding a thread sheet may have means for automated transport of the thread sheet during the drawing-in. With known drawing-in machines, means for the automatic transport of a thread sheet, if provided at all, are arranged immovably at the drawing-in machine. For the handling of a mobile unit and the accessibility to other modules of a drawing-in machine, the same applies here as in the case of the holding means for the reed.

The drawing-in machine according to the invention for drawing threads into weaving accessories comprises a holding means for a reed. According to the invention, a reed-holding means which is arranged at a mobile unit may be arranged at the reed-holding means of the drawing-in machine. This means that on the "unloading side", i.e. in a direction in which drawn-in weaving accessories are transported away during drawing-in, the drawing-in machine has no stationary machine components that take up installation space in the weaving mill. Access to the drawing-in machine is also easier.

The holding means for a reed may comprise a hollow profile extending in the longitudinal direction. This hollow profile advantageously matches a hollow profile used in a reed-holding means of a mobile unit, thereby enabling the holding means of the mobile unit to be connected easily and in uncomplicated manner to the drawing-in machine.

The holding means for a reed may comprise at least one carriage, which carries the reed and is guided slidably along the hollow profile. It is advantageous if roller pairs fixed to the at least one carriage embrace the hollow profile from a plurality of sides and thereby guide the at least one carriage and hence the reed securely and exactly. The at least one carriage may comprise a plurality of parts. A carriage of this kind can be moved during the drawing-in from the reed-holding means of the drawing-in machine to a reed-holding means of the mobile unit. This arrangement obviates the need for a holding device which reaches right through the drawing-in machine and which, as seen from the drawing-in module, extends over approximately the same length in two directions and takes up the corresponding amount of installation space even if the drawing-in machine is not in use. After drawing-in has taken place, the at least one carriage can remain at the mobile unit or, if the reed is transferred to the mobile unit, be pushed back again onto the reed-holding means of the drawing-in machine.

The drawing-in machine may comprise a lease-making device. A holding means for a thread sheet arranged at a mobile device may be arranged at the lease-making device, thereby again obviating the need for machine components fixed to the drawing-in machine. Ultimately, the drawing-in machine may be completely devoid of stationary machine components on the unloading side. As a result, a huge amount of installation space is freed up when the drawing-in machine is not in use. During a drawing-in, the drawing-in machine inclusive of the mobile unit also takes up significantly less installation space when a shorter reed is drawn in than the construction of the drawing-in machine allows for and a mobile unit of matching length is used.

BRIEF DESCRIPTION OF THE DRAWINGS

FIG. 1 shows a symbolic oblique view of some essential components of a device according to the invention or of a drawing-in machine according to the invention.

DETAILED DESCRIPTION

FIG. 1 shows a symbolic, oblique sectional view of some essential components of a device 1 according to the invention, or of a drawing-in machine 5. A reed 3 is attached to a carriage 7 in a manner not shown. The carriage 7 comprises two rollers 8, which guide the carriage along a hollow profile 4. The carriage 7 and thus the reed 3 are arranged in this exemplary manner to be slidable along the hollow profile 4 in the longitudinal direction L. The two rollers 8 embrace the hollow profile 4 in the elevational direction H, thereby ensuring that the reed 3 is guided securely and exactly. At its end, the hollow profile 4 comprises components to facilitate coupling the profile with another hollow profile, which is not shown. Components of this kind may be mounted at the end of the hollow profile 4, which is disposed at the device 1 of the invention and accordingly at the holding means 2 for a reed 3 arranged at the mobile unit. Components of this kind may be mounted at the end of the hollow profile 4, which is disposed at the holding means 6 for a reed 3 arranged at the drawing-in machine 5.

| List of reference numerals | |
|---|---|
| 1 | Device |
| 2 | Reed holding means of a device 1 |
| 3 | Reed |
| 4 | Hollow profile |
| 5 | Drawing-in machine |
| 6 | Reed holding means of a drawing-in machine 5 |
| 7 | Carriage |
| 8 | Roller |

The invention claimed is:

1. A device (1) for handling weaving accessories, said device being provided as a mobile unit and comprising:

a reed holding portion configured (2) for holding a reed (3);

wherein the reed holding portion (2) is configured for picking up a carriage to which the reed (3) is operably connected from a corresponding reed holding portion of a drawing-in machine during a drawing-in process, wherein the reed holding portion is further configured for movably supporting the carriage and the reed (3) with the reed (3) positioned adjacent to the reed holding portion (2).

2. The device (1) according to claim 1, wherein the reed holding portion (2) comprises an elongate hollow profile (4) extending in a longitudinal direction (L).

3. The device (1) according to claim 2, wherein the hollow profile (4) includes opposite ends that are configured to be positioned at a plurality of different heights along an elevational direction (H) with respect to the mobile unit.

4. A drawing-in machine (5) for drawing threads into weaving accessories, the drawing-in machine (5) comprising:

a reed holding portion (6) configured for movably supporting (6) a reed (3);

wherein the reed holding portion (6) is configured to be removably connected to a corresponding reed holding portion (2) of a mobile unit so that a reed supported by the reed holding portion (6) is moveable from the reed holding portion (6) of the drawing-in machine (5) to the corresponding reed holding portion (2) of the mobile unit during a drawing-in process.

5. The drawing-in machine (5) according to claim 4, wherein the reed holding portion (6) of the drawing-in machine (5) comprises a hollow profile (4) extending in a longitudinal direction (L).

6. The drawing-in machine (5) according to claim 5, wherein the reed holding portion (6) comprises at least one carriage (7) configured to carry a reed (3) and which is guided slidably along the hollow profile.

* * * * *